US005725208A

United States Patent [19]

Miyauchi

[11] Patent Number: 5,725,208

[45] Date of Patent: Mar. 10, 1998

[54] SHEET SUPPLYING AND CONVEYING APPARATUS

[75] Inventor: Yasuo Miyauchi, Machida, Japan

[73] Assignee: Canon Kabushiki Kaisha, Tokyo, Japan

[21] Appl. No.: 879,136

[22] Filed: Jun. 19, 1997

Related U.S. Application Data

[63] Continuation of Ser. No. 628,447, Apr. 5, 1996, abandoned.

[30] Foreign Application Priority Data

Apr. 10, 1995 [JP] Japan ..... 7-084288

[51] Int. Cl.[6] ..... B65H 5/00

[52] U.S. Cl. ..... 271/10.09; 271/121; 271/125; 271/127; 271/272

[58] Field of Search ..... 271/4.08, 10.09, 271/10.13, 109, 121, 122, 125, 126, 127, 272, 160

[56] References Cited

U.S. PATENT DOCUMENTS

| | | | |
|---|---|---|---|
| 4,715,597 | 12/1987 | Seukurai | 271/122 |
| 4,801,134 | 1/1989 | Yokoyama et al. . | |
| 5,016,866 | 5/1991 | Takahashi . | |
| 5,126,764 | 6/1992 | Miyauchi et al. . | |
| 5,128,727 | 7/1992 | Miyauchi et al. . | |
| 5,172,899 | 12/1992 | Tajima . | |
| 5,351,945 | 10/1994 | Asakawa et al. | 271/127 |
| 5,358,230 | 10/1994 | Ikemori et al. | 271/127 |
| 5,551,685 | 9/1996 | Hori | 271/109 |

FOREIGN PATENT DOCUMENTS

| | | | |
|---|---|---|---|
| 357027839A | 2/1982 | Japan | 271/10.09 |
| 62-105834 | 5/1987 | Japan . | |
| 1-139286 | 5/1989 | Japan . | |
| 2 140 784 | 12/1984 | United Kingdom . | |

OTHER PUBLICATIONS

Patent Abstracts of Japan, vol. 017, No. 330 (M-1434), 23 Jun. 1993 & JP 05-03931 A (Matsushita Electric Ind. Co. Ltd.), 19 Feb. 1993.

Patent Abstracts of Japan, vol. 018, No. 508 (M-1678), 26 Sep. 1994 & JP 06-171783 A (Ricoh Co. Ltd.) 21 Jun. 1994.

*Primary Examiner*—H. Grant Skaggs

*Attorney, Agent, or Firm*—Fitzpatrick, Cella, Harper & Scinto

[57] ABSTRACT

The present invention provides a sheet supplying and conveying apparatus comprising a sheet supporting means for supporting sheets, a convey roller contacted with the sheet supported by the sheet supporting means with predetermined sheet supplying pressure and adapted to feed out the sheet and convey the sheet around the convey roller by rotation of the convey roller, a separation rotary member urged against the convey roller with predetermined separation pressure and adapted to separate the sheets fed out by the convey roller one by one, a torque limiter for permitting rotation of the separation rotary member in a sheet conveying direction when rotational torque directing toward the sheet conveying direction and having a value greater than a predetermined value acts on the separation rotary member and for preventing the rotation of the separation rotary member in the sheet conveying direction when the rotational torque having a value smaller than the predetermined value acts on the separation rotary member, and a pressure releasing means for releasing the sheet supplying pressure and the separation pressure on the way of the conveyance of the sheet by the convey roller. The present invention further provides a recording apparatus having such a sheet supplying and conveying apparatus.

25 Claims, 8 Drawing Sheets

SHEET SUPPLYING AND CONVEYING APPARATUS

This application is a continuation of application Ser. No. 08/628,447, filed Apr. 5, 1996, now abandoned.

BACKGROUND OF THE INVENTION

1. Field of the Invention

The present invention relates to a recording apparatus used with an image forming apparatus such as a printer, a copying machine, a word processor, a personal computer, a facsimile machine and the like, and a sheet supplying and conveying apparatus used with such a recording apparatus.

2. Related Background Art

In the past, among recording apparatuses used with an image forming apparatus such as a printer, some recording apparatuses have a sheet conveying apparatus in which a sheet supply roller also acts as a convey roller so that a sheet is conveyed from a sheet supply portion to a recording area by a single large diameter roller (convey roller). In such a conventional apparatus, as disclosed in the Japanese Patent Application Laid-Open No. 1-139286 (1989), a driven convey roller serves to pick-up and supply a recording material (sheet) from a sheet stack disposed below the convey roller and to U-turn the sheet around the convey roller and then to send the sheet to a recording area of a recording means disposed above the convey roller.

The convey roller comprises a plurality of rubber roller portions mounted on a single drive shaft so as to reduce the total weight of the large diameter roller. With this arrangement, since the number of parts in a sheet supply and convey portion can be reduced, the entire apparatus can be made cheaper considerably and even a thick sheet can be U-turned and conveyed by the large diameter roller. Further, if the large diameter roller is manufactured with the same manufacturing accuracy as that of a small diameter roller, since a ratio in error regarding a radius becomes smaller, conveying accuracy can be improved.

On the other hand, as a supply and separation means, as disclosed in the Japanese Patent Application Laid-Open No. 62-105834 (1987), there has been proposed a technique in which a separation roller is urged against a driven convey roller so that a sheet can be separated from the other sheet by control torque of a torque limiter attached to the separation roller. More specifically, if a single sheet is positioned between the convey roller and the separation roller, great rotational torque acts on the torque limiter, with the result that the torque limiter permits synchronous rotational movement between the convey roller and the separation roller. To the contrary, if two or more sheets are positioned between the convey roller and the separation roller, relatively small rotational torque acts on the torque limiter, thereby preventing the synchronous rotational movement between the convey roller and the separation roller by the torque limiter, with the result that a single recording sheet is conveyed by the convey roller and the conveyance of the other sheets is prevented by the separation roller.

With this arrangement, the supply and separation means has durability superior to that of a supply and separation means utilizing a separation pad and can prevent noise due to vibrational contact between the sheet and the separation pad, thereby achieving stable sheet supply.

However, in the recording apparatus in which the sheet is conveyed from the sheet supply portion to the recording area by the single large diameter roller, if the separation roller (separation means) is urged against the large diameter roller via the torque limiter, even when the sheet supply and separation is completed, the large diameter roller continues to rotate to convey the sheet. As a result, since the separation roller is rotated together with the large diameter roller, after a trail end of the first recording sheet leaves, the other sheets disposed upstream of the separation roller will often be pulled by the separation roller, with the result that the other sheet may be conveyed by the large diameter roller and the separation roller (double-feed).

That is to say, while an image is formed on the separated sheet in the recording area, the large diameter roller continues to rotate. As a result, since the separation roller is continuously rotated by the large diameter roller, if tip end of the other sheet is contacted with the large diameter roller or/and the separation roller, the other sheet is pulled by the roller, thereby causing the double-feed of sheets. If the double-feed of sheets occurs, the other sheet must be treated as jammed sheet.

Further, since the sheet was conveyed from the supply and separation portion to the recording area by the single large diameter roller, it was difficult to determine rubber material constituting the large diameter roller. That is to say, regarding sheet supplying ability, rubber material having smaller hardness and high friction coefficient between the sheet and the large diameter roller is preferable; to the contrary, regarding conveying ability (particularly, conveying speed), rubber material having greater hardness and great frictional durability (small wear) is preferable. Thus, it is difficult to select rubber material satisfying both requirements.

SUMMARY OF THE INVENTION

An object of the present invention is to provide a recording apparatus and a sheet supplying and conveying apparatus used with such a recording apparatus, in which sheet supply and sheet conveyance can be effected by a single large diameter roller and which can achieve excellent sheet supplying ability and sheet conveying ability and prevent double-feed of sheets.

To achieve the above object, according to the present invention, there is provided a sheet supplying and conveying apparatus comprising a sheet supporting means for supporting sheets, a convey roller contacted with the sheet supported by the sheet supporting means with predetermined sheet supplying pressure and adapted to feed out the sheet and convey the sheet around the convey roller by rotation of the convey roller, a separation rotary member urged against the convey roller with predetermined separation pressure and adapted to separate the sheets fed out by the convey roller one by one, a torque limiter for permitting rotation of the separation rotary member in a sheet conveying direction when rotational torque directing toward the sheet conveying direction and having a value greater than a predetermined value acts on the separation rotary member and for preventing the rotation of the separation rotary member in the sheet conveying direction when the rotational torque having a value smaller than the predetermined value acts on the separation rotary member, and a pressure releasing means for releasing the sheet supplying pressure and the separation pressure on the way of the conveyance of the sheet by the convey roller.

According to the sheet supplying and conveying apparatus of the present invention, when a sheet supplying operation is performed, that is, when the sheet supporting means is biased by a biasing means to urge the sheets on the sheet supporting means against the convey roller, the separation rotary member is also contacted with the convey roller, so that the sheet separating and conveying operation is effected. On the other hand, after the sheet separating and conveying operation is finished, when the sheet supporting means is pushed downwardly in opposition to a biasing force of the biasing means, the separation rotary means is separated from the convey roller in synchronous with the downward movement of the sheet supporting means to stop the sheet separating and conveying operation completely. Thus, even if the succeeding sheet(s) exists in the vicinity of a nip between the convey roller and the separation rotary means, the succeeding sheet(s) is not conveyed erroneously.

DETAILED DESCRIPTION OF THE PREFERRED EMBODIMENTS

The present invention will now be explained in connection with embodiments thereof with reference to the accompanying drawings.

<First Embodiment>

Figure 1:
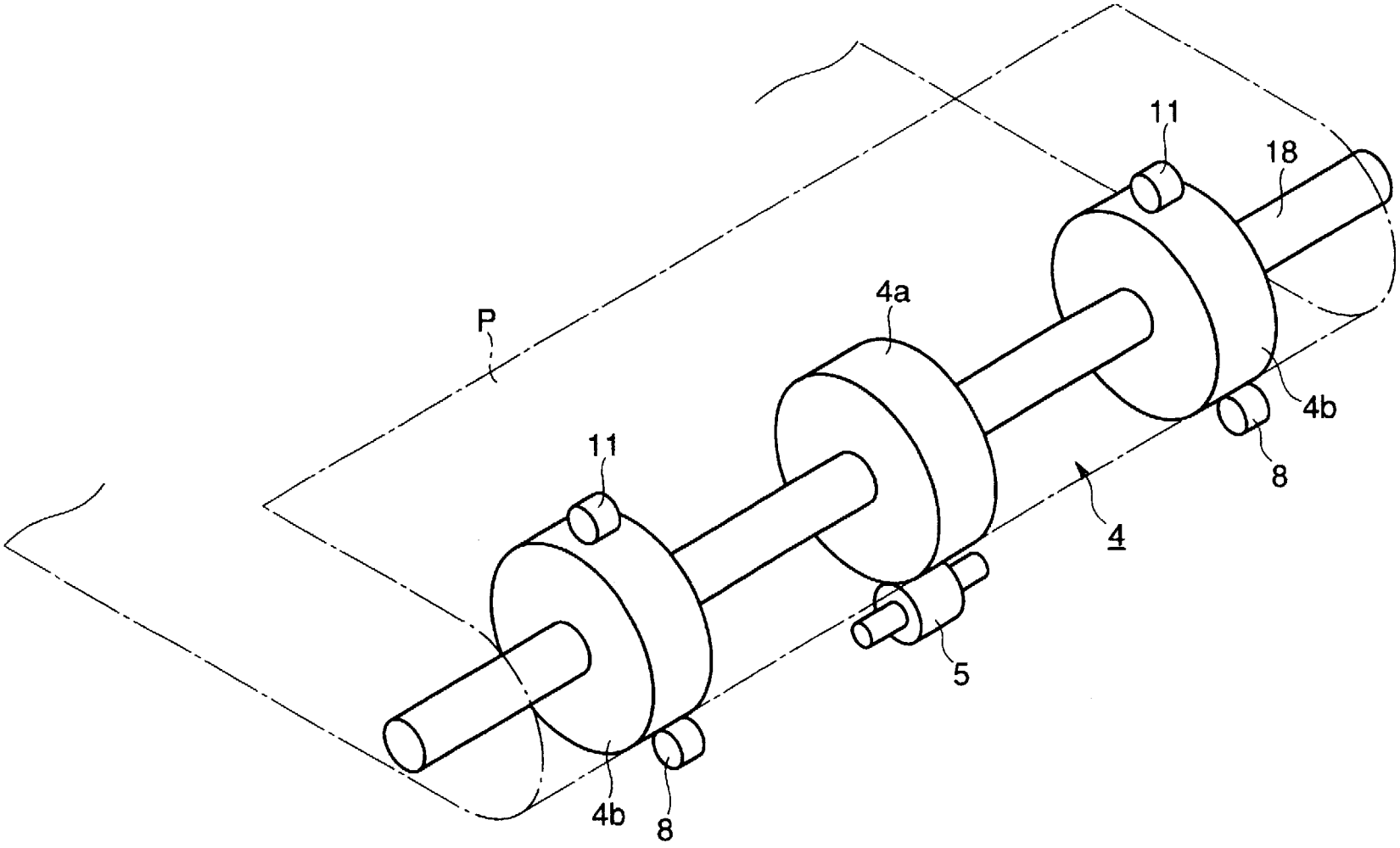
FIG. 1 is a partial perspective view of a sheet supplying and conveying apparatus according to a first embodiment of the present invention.
Figure 2:
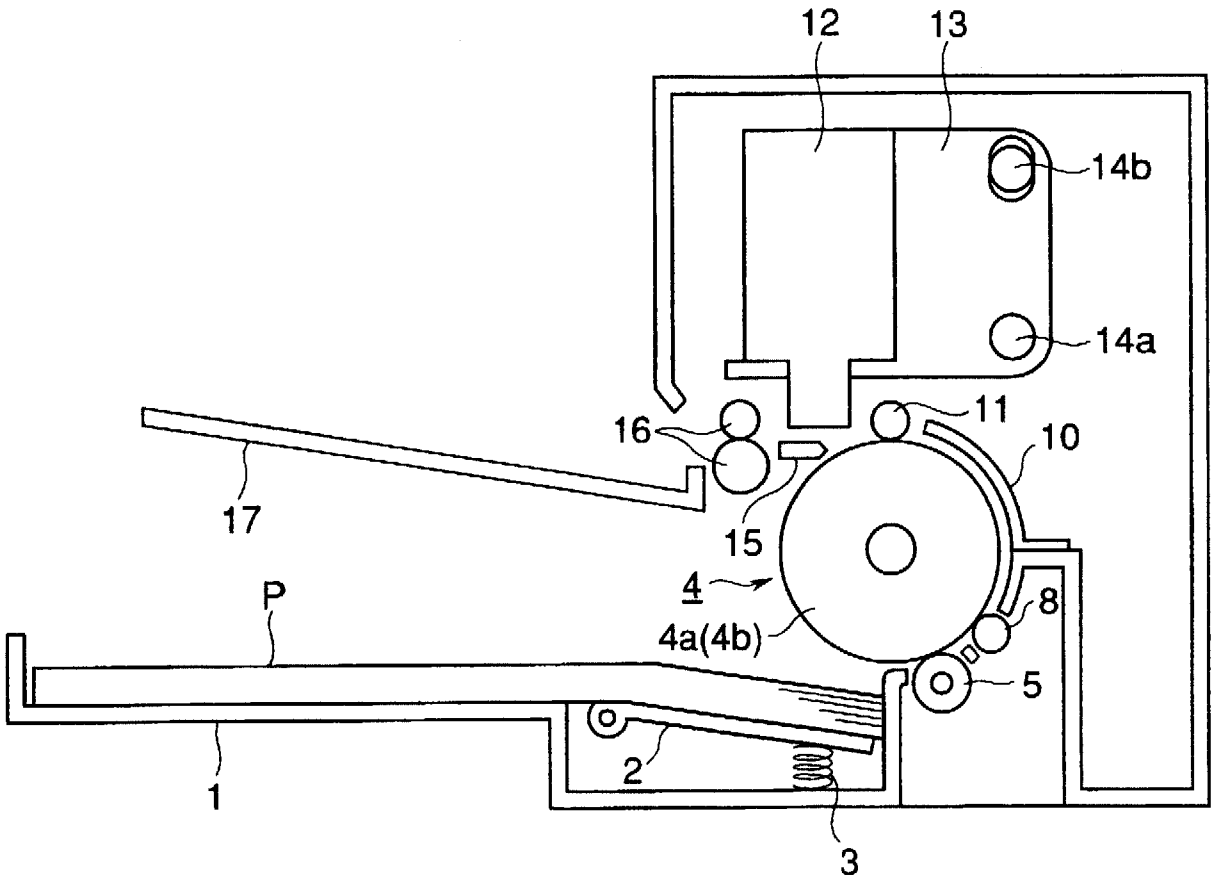
FIG. 2 is a sectional view of the sheet supplying and conveying apparatus.

First of all, a recording apparatus, and a sheet supplying and conveying apparatus used with such a recording apparatus will be described with reference to FIGS. 1 and 2. FIG. 1 is a perspective view of the sheet supplying and conveying apparatus, and FIG. 2 is a sectional view of the recording apparatus. Incidentally, in this embodiment, an ink jet printer will be explained as an example of the recording apparatus.

A construction of the ink jet printer will firstly be described with reference to FIG. 2. A sheet supply portion (sheet stacking means) 1 is constituted by a part of a frame of the printer and serves to contain cut sheets P such as recording sheet in a stacked condition. A pressure plate (sheet supporting means) 2 is pivotally attached to a right end (FIG. 2) of the sheet supply portion 1.

The pressure plate 2 is biased upwardly by springs (biasing means) 3 from a lower side so that an upper surface of a tip end (right end in FIG. 2) portion of a sheet stack P rested on the pressure plate 2 against a rubber roller (first elastic roller) 4*a* (FIG. 1). The rubber roller 4*a* serves to pick up the sheet P from the sheet supply portion 1 and to U-turn and convey the sheet up to a recording position of the recording means which will be described later (refer to FIG. 1).

A separation roller (separation means) 5 is urged against the rubber roller 4*a*. By applying predetermined braking torque to the separation roller 5, the recording sheets P can be separated one by one. The separated recording sheet P is conveyed by rubber rollers (second elastic rollers) 4*b* and driven pinch rollers 8 urged against the rubber rollers 4*b* (as will be described later, the rubber roller 4*a* and the rubber rollers 4*b* have the same diameter and are mounted on a common shaft).

A convey guide partially surrounds the rubber rollers 4*a*, 4*b* to provide a recording sheet convey path. Pinch rollers 11 are urged against the corresponding rubber rollers 4*b* and are driven by rotations of the rubber rollers 4*b*.

A recording head 12 acting as the recording means serves to form an ink image on the sheet P conveyed by the rubber rollers 4*a*, 4*b* (convey means). In the illustrated embodiment, the recording head is of ink jet recording type in which the image is formed by discharging ink from the recording head 12. That is to say, the recording head 12 includes fine liquid (ink) discharge openings (orifices), liquid passages, energy acting portions disposed within the liquid passages, and energy generating means for generating energy applying to the energy acting portions. As recording methods having such energy generating means, there have been proposed a recording method using electrical/mechanical converters such as piezo-electric elements, a recording method having energy generating means in which liquid is heated by applying electromagnetic waves such as laser to discharge liquid droplets under the action of heat, and a recording method utilizing energy generating means in which liquid is heated by electrical/thermal converters having heat generating resistors to discharge the liquid.

Among these recording methods, a recording head used in an ink jet recording method can effect the recording with high resolving power since ink discharge openings (orifices) for discharging ink droplets to form an image can be arranged with high density. Among various kinds of ink jet recording heads, a recording head utilizing electrical/thermal converters as energy generating means is advantageous since it can easily be made compact, it can effectively utilize advantages of IC techniques and micro-working techniques which have been remarkably progressed in a recent semi-conductor field and in which reliability thereof has been remarkably be improved, they can easily be mounted with high density and it can be made cheaper.

The recording head 12 is mounted on a carriage 13. The carriage 13 is reciprocally shifted along rails 14*a*, 14*b* in a width-wise direction of the recording sheet (direction perpendicular to the plane of FIG. 2). In this case, the recording head 12 discharges ink droplets in response to image information, thereby forming the image on the recording sheet P. A platen 15 disposed in a confronting relation to the recording head 12 serves to support the recording sheet P from a lower side. A pair of sheet discharge rollers 16 serves to discharge the recording sheet P onto a sheet discharge tray 17 disposed out of the printer.

Next, a construction of the supply and convey means (rubber rollers 4*a*, 4*b*) will be fully explained with reference to FIG. 1.

In FIG. 1, a driving force from a drive source (not shown) is transmitted to a drive shaft 18 to rotate the latter. The rubber roller 4*a* is fitted on (secured to) the drive shaft 18 at a central position thereof, and the rubber rollers 4*b* are also fitted on (secured to) the drive shaft 18 on both sides of the rubber roller 4*a*. The separation roller 5 having the predetermined braking torque is urged against the rubber roller 4*a*.

Further, the pinch rollers 8, 11 are urged against the corresponding rubber roller 4b.

The rubber roller 4a is formed from rubber material (for example, EPDM group) having small hardness and great frictional coefficient (regarding the sheet) so that the sheets can positively be separated one by one by the cooperation of the rubber roller 4a and the separation roller 5. In the illustrated embodiment, the rubber roller 4a is formed to have hardness of 27° (JIS hardness) and frictional coefficient μ of 2.3.

On the other hand, each rubber roller 4b is formed from rubber material (for example, EPDM group) having relatively great hardness and good anti-wear property so that stable sheet conveyance can be provided without any skew-feed by the cooperation of each rubber roller 4b and the corresponding pinch rollers 8, 11. In the illustrated embodiment, each rubber roller 4b is formed to have hardness of 50° (JIS hardness) and frictional coefficient μ of 1.5.

That is to say, in the recording apparatus (printer) having the sheet supplying and conveying apparatus in which the sheet is conveyed from the sheet supply portion to the recording position by the large diameter convey roller 4 (rubber rollers 4a, 4b) according to the illustrated embodiment, separating/supplying ability and conveying ability can be achieved with a simple construction, and the separating/supplying ability and the conveying ability can be improved remarkably.

Incidentally, in the illustrated embodiment, while an example that the rubber rollers 4a, 4b are directly fitted on the drive shaft 18 was explained, each rubber roller may be constituted by an endless rubber mounted on the drive shaft via a molded ring or by an endless rubber mounted on a molded ring integrally formed with the drive shaft.

<Second Embodiment>

Figure 3:
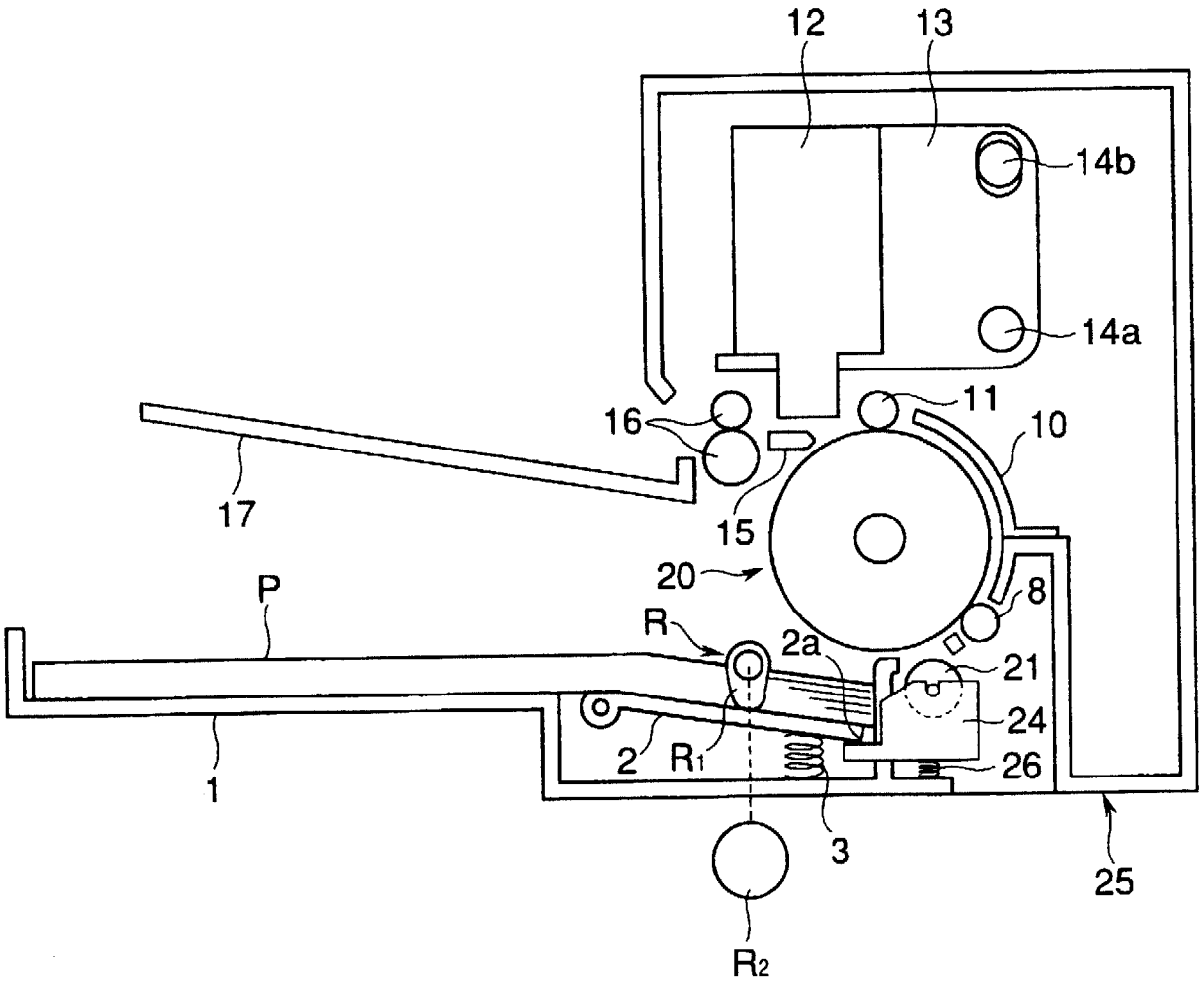
FIG. 3 is a sectional view of a sheet supplying and conveying apparatus according to a second embodiment of the present invention.
Figure 4:
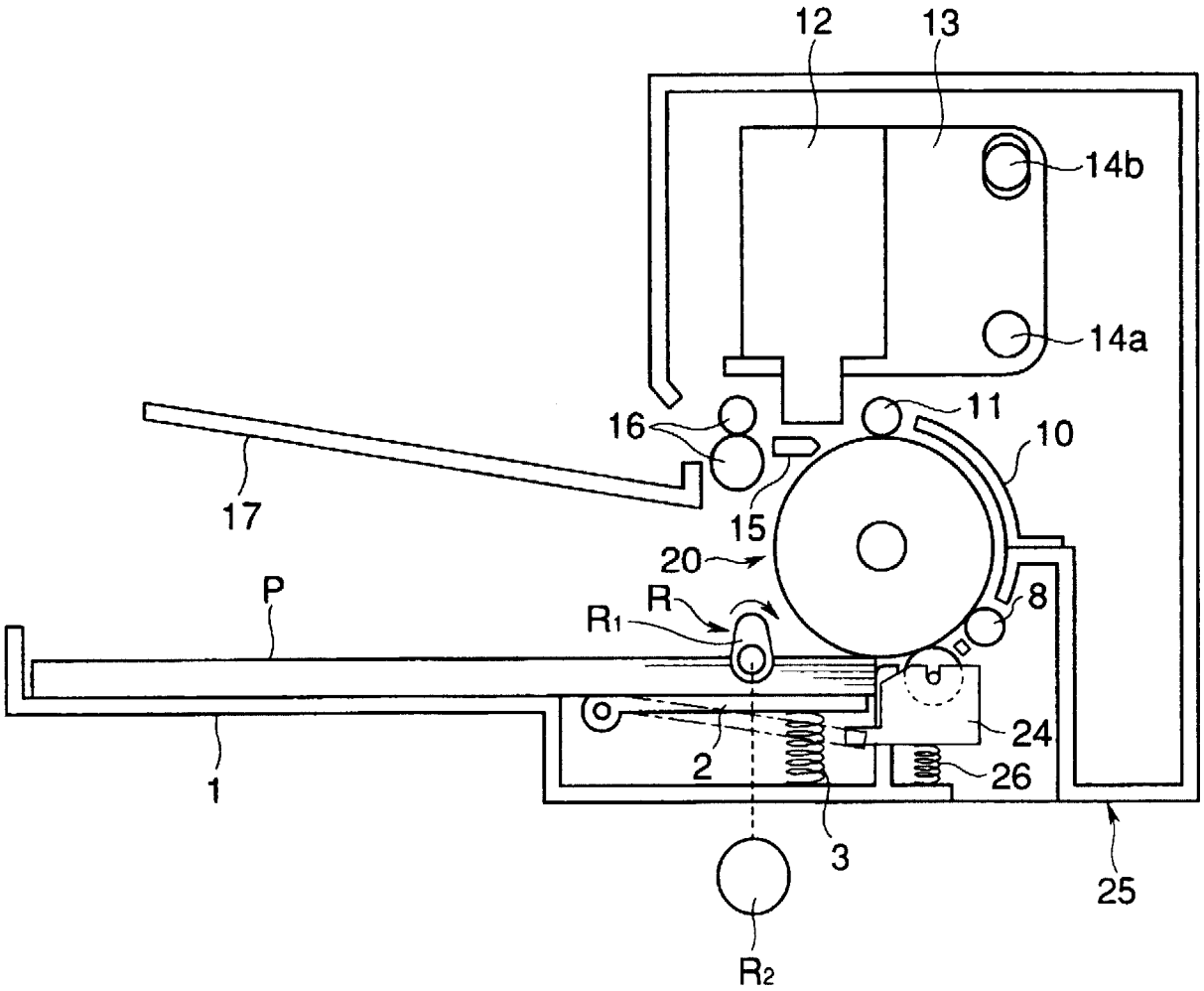
FIG. 4 is a sectional view of the sheet supplying and conveying apparatus, showing an operating condition.

FIGS. 3 and 4 are sectional views showing a recording apparatus according to a second embodiment of the present invention. Explanation of the same elements as those in the first embodiment is omitted, and differences with respect to the first embodiment is mainly explained.

The pressure plate 2 disposed at the right end of the sheet supply portion 1 is pushed downwardly to a position shown in FIG. 3 in opposition to the biasing forces of the springs 3 by means of a sheet supply pressure releasing means R comprised of a cam and the like, and is held there. The sheet supply pressure releasing means R includes a cam $R_1$ to which a rotational driving force is transmitted from a drive source such as a motor, and a rotation controlling means (one-revolution clutch) $R_2$ for transmitting the rotation to the cam $R_1$ to rotate the later by a predetermined amount (for example, one revolution).

Figure 5:
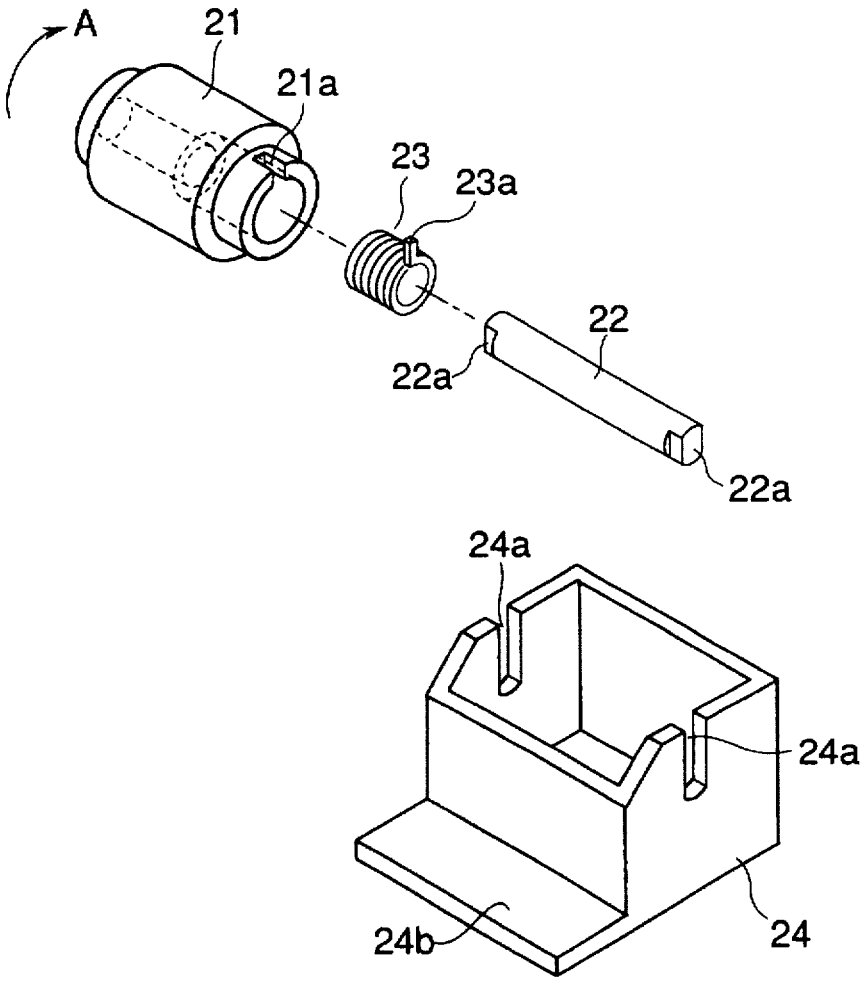
FIG. 5 is an exploded perspective view of a main portion of the sheet supplying and conveying apparatus.

In the illustrated embodiment, as shown in FIG. 5, a separation roller 21 acting as a separation means (separation rotary member) is mounted on a clutch shaft 22 via a clutch spring (torque limiter) 23, and the separation roller 21 is incorporated into a holder 24 by engaging the clutch shaft 22 with the holder. More particularly, engagement portions 22a formed on both ends of the clutch shaft 22 are non-rotatably fitted into engagement recesses 24a formed in the holder 24. The clutch spring 23 is connected to the separation shaft 21 via engagement portions 23a, 21a. With this arrangement, when the separation roller 21 is rotated in a direction shown by the arrow A, loosing torque of the clutch spring acts on the separation roller as braking torque.

The holder 24 is mounted on a frame for only vertical movement and is biased by a spring 26 toward a convey roller 20. However, since the holder is associated with the pressure plate 2, the separation roller 21 can be separated from and contacted with the convey roller 20 in accordance with pivotal movement of the pressure plate 2. That is to say, an engagement portion 24b of the holder 24 is depressed downwardly by a tip end 2a (separation pressure releasing means) of the pressure plate 2, the separation roller 21 is spaced apart from the convey roller 20.

When the rotation is transmitted to the cam $R_1$ by the rotation controlling means $R_2$ in response to a sheet supply signal, the pressure plate 2 starts to be lifted by the biasing forces of the springs 3. As a result, the holder 24 also starts to be lifted by a biasing force of the spring 26. As soon as before the sheet stack on the pressure plate is contacted with the convey roller 20, the separation roller 21 is contacted with the convey roller 20, as shown in FIG. 4.

In this case, if there is a single recording sheet P between the convey roller 20 and the separation roller 21, when the rotational torque acting on the separation roller 21 reaches a predetermined value to overcome the braking torque of the clutch spring 23, the separation roller 21 is rotated in synchronous with the rotation of the convey roller 20. On the other hand, if there are two or more recording sheets P between the convey roller 20 and the separation roller 21, since the rotational torque acting on the separation roller 21 cannot overcome the braking torque of the clutch spring 23, the rotation of the separation roller 21 is prevented by the braking action of the clutch spring 23. As a result, a lower sheet (among two recording sheets existing between the convey roller 20 and the separation roller 21) is trapped by the stopped separation roller 21, with the result that an upper sheet alone is conveyed by the convey roller 20. When the recording sheet P is pinched between the convey roller and the pinch rollers 8 (completion of separating and supplying operation), as the cam $R_1$ is rotated by one revolution, the pressure plate 2 is depressed downwardly to separate the separation roller 21 from the convey roller 20, thereby restoring a condition shown in FIG. 3. One revolution of the cam $R_1$ is completed while the recording sheet P is being conveyed by the convey roller 20 (before a trail end of the recording sheet leaves a nip between the convey roller 20 and the separation roller 21), thereby releasing the sheet supplying pressure and the separation pressure.

Accordingly, according to the illustrated embodiment, the succeeding sheets remaining in the vicinity of the nip between the convey roller 20 and the separation roller 21 can be prevented from being conveyed together with the preceding sheet (separated recording sheet) toward the recording head 12. The reason is that, even if the remaining sheet(s) is contacted with the convey roller 20 or the separation roller 21, the separation roller is separated from the convey roller 20 by the downward movement of the pressure plate 2, so that the remaining sheet(s) is prevented from being advanced by the stopped separation roller 21.

By completing the sheet supplying operation prior to the initiation of the recording operation, since the recording sheet is not subjected to back tension of the separation roller 21 during the recording operation of the recording head 12, formation of white stripes or black stripes in the image due to fluctuation of load can be prevented.

Further, there is no back tension, the back-feed of the recording sheet can surely effected.

<Third Embodiment>

Figure 6:
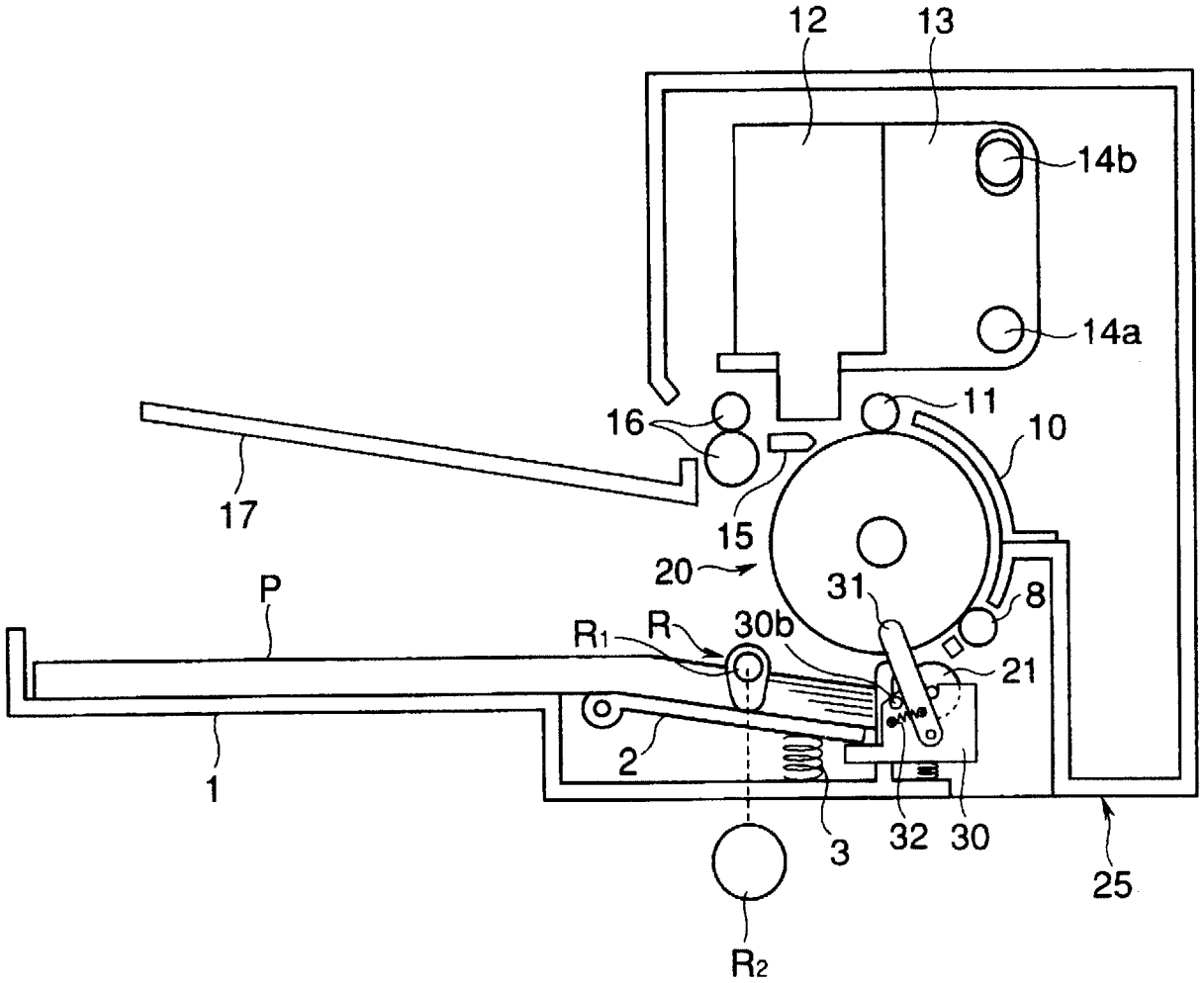
FIG. 6 is a sectional view of a sheet supplying and conveying apparatus according to a third embodiment of the present invention.
Figure 7:
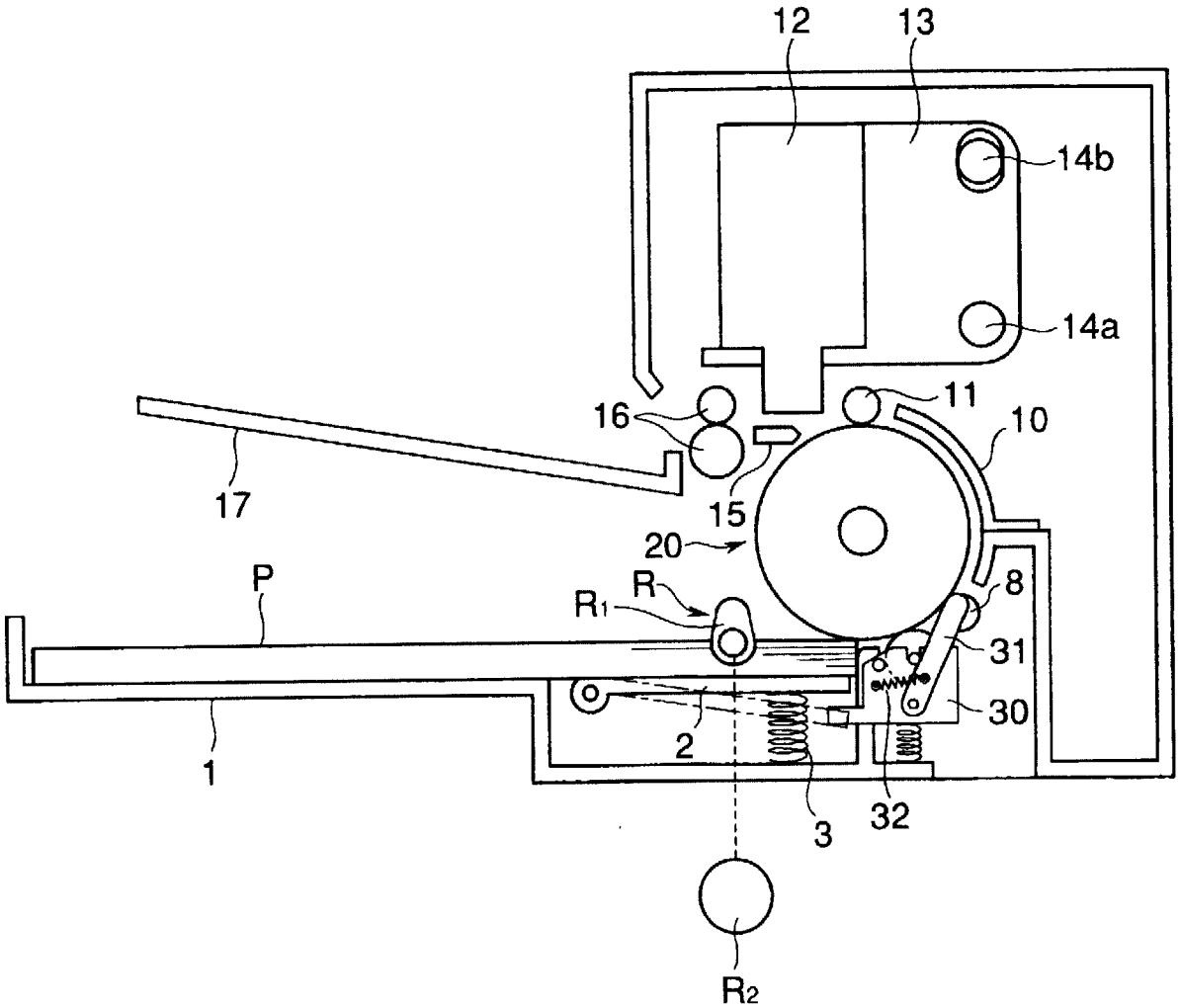
FIG. 7 is a sectional view of the sheet supplying and conveying apparatus, showing an operating condition.

FIGS. 6 and 7 are sectional views showing a recording apparatus according to a third embodiment of the present invention. Incidentally, the same elements as those in the first and second embodiments are designated by the same reference numerals and explanation thereof will be omitted.

In FIGS. 6 and 7, a return lever (sheet returning means) 31 is pivotally mounted on a holder 30. The return lever 31 is biased in an anti-clockwise direction (FIG. 6) by a spring 32 to normally abut against a stopper 30*b*. Incidentally, the return lever 31 is disposed between the rubber rollers 4*a* and 4*b* (refer to FIG. 1).

When the sheet supplying operation is started, as is in the second embodiment, the pressure plate 2 is lifted and the holder 30 is also lifted accordingly to urge the separation roller 21 against the convey roller 20. As the uppermost sheet P is supplied, the tip end of the recording sheet P is advanced while rocking the return lever 31 downwardly (condition as shown in FIG. 7). In this case, since a spring force of the spring 32 is set to a weak force in the order of 10 gf, the tip end of the recording sheet P is not damaged by the return lever.

During the recording operation, when the trail end of the recording sheet P leaves the return lever 31, the return lever 31 is snappingly returned to a position shown in FIG. 2 by the spring force of the spring 32. In this case, the separation roller 21 has already been spaced apart from the convey roller 20. Accordingly, the succeeding sheet(s) remaining in the vicinity of the nip between the convey roller 20 and the separation roller 21 can easily and positively be returned to the sheet supply portion 1.

As mentioned above, according to this embodiment, since the succeeding sheet(s) is always returned to the sheet supply portion 1 (because the separation roller 21 is spaced apart from the convey roller 20), the double-feed of sheets can surely be prevented.

Figure 8:
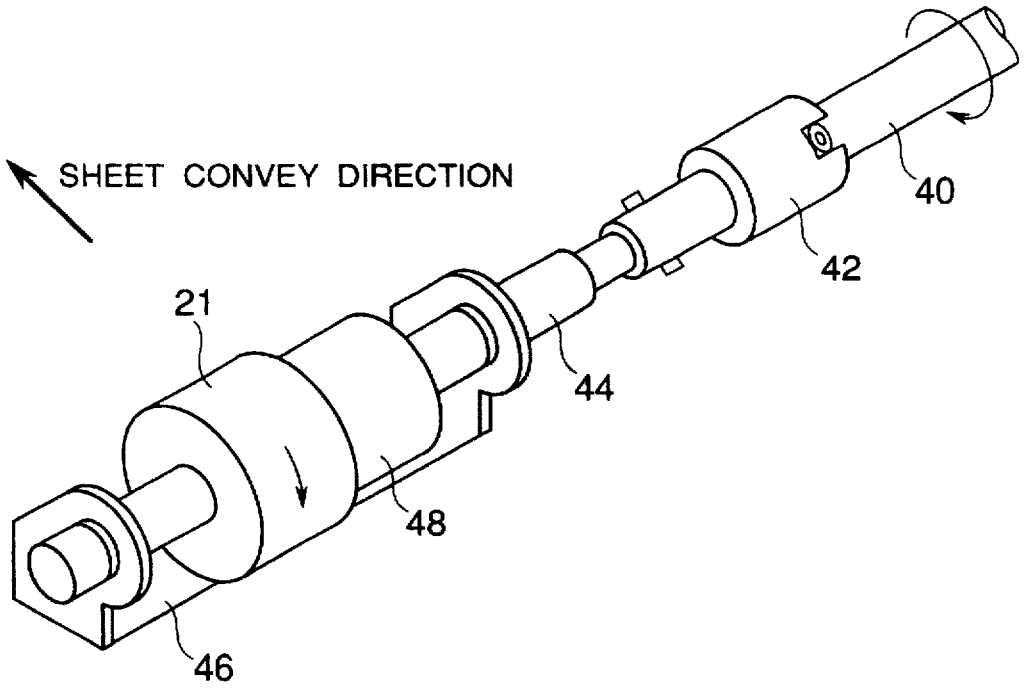
FIG. 8 is a perspective view of a torque limiter according to another embodiment.

FIG. 8 is a perspective view showing another embodiment of the separation means. In this embodiment, the separation roller 21 is rotated in a direction opposite to a sheet convey direction.

More specifically, a drive shaft 40 connected to a motor is connected to a supply shaft 44 via a coupling 42. The supply shaft 44 is rotatably supported by a holder 46, and the separation roller 21 is connected to the supply shaft 44 via a torque limiter 48. The coupling 42 serves to transmit a driving force from the drive shaft 40 to the supply shaft 44 even when the holder 46 is shifted in an up-and-down direction.

If there is a single sheet between the convey roller 20 and the separation roller 21, the torque limiter 48 is subjected to great rotational torque from the separation roller 21 through the sheet, thereby blocking the transmission of the driving force to the separation roller 21. As a result, the separation roller 21 is rotated by the movement of the sheet being conveyed. On the other hand, if there are two or more sheets between the convey roller 20 and the separation roller 21, since the torque limiter 48 is subjected to small frictional resistance between the sheets, the driving force is transmitted from the torque limiter 46 to the separation roller 21, thereby rotating the separation roller in the direction opposite to the sheet convey direction. As a result, the sheets can be separated one by one positively.

Incidentally, the arrangement for separating the separation roller 21 from the convey roller 20 is the same as that shown in the second embodiment. Further, when the separation roller 21 is separated from the convey roller, the transmission of the driving force to the separation roller 21 may be interrupted or the separation roller may be still rotated in the reverse direction.

Incidentally, the above-mentioned embodiments may be combined appropriately. For example, the construction of the convey roller 4 shown in the first embodiment can be applied to the convey roller 20 of the second embodiment.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet supplying and conveying apparatus comprising:

a sheet supporting means for supporting sheets;

a convey roller contacted with the sheet supported by said sheet supporting means with a predetermined sheet supplying pressure for feeding out the sheet and conveying the sheet around said convey roller by a rotation thereof;

a separation rotary member urged against said convey roller with predetermined separation pressure for separating the sheets fed out by said convey roller one by one;

a torque limiter (i) for permitting rotation of said separation rotary member in a sheet conveying direction when a rotational torque directing toward the sheet conveying direction and having a value greater than a predetermined value acts on said separation rotary member and (ii) for preventing the rotation of said separation rotary member in the sheet conveying direction when the rotational torque having a value smaller than the predetermined value acts on said separation rotary member; and a pressure releasing means for releasing the sheet supplying pressure and the separation pressure on the way of the conveyance of the sheet by said convey roller.

2. A sheet supplying and conveying apparatus according to claim 1, wherein said sheet supporting means has a sheet support member for supporting the sheets, and a biasing means for biasing said sheet support member toward said convey roller to urge the sheets supported by said sheet support member against said convey roller; and, said pressure releasing means has a sheet supplying pressure releasing means for shifting said sheet support member away from said convey roller in opposition to a biasing force of said biasing means, and a separation pressure releasing means for separating said separation rotary member from said convey roller when said sheet support member is shifted away from said convey roller by said sheet supplying pressure releasing means.

3. A sheet supplying and conveying apparatus according to claim 2, wherein said sheet support member is a pivotable pressure plate, and said biasing means is a spring for elastically biasing said pressure plate toward said convey roller; wherein said sheet supplying pressure releasing means is so designed as to separate said pressure plate from said convey roller in opposition to an elastic force of said spring.

4. A sheet supplying and conveying apparatus according to claim 3, wherein said sheet supplying pressure releasing means has a cam which can be rotated to slidably contacted with said pressure plate, and a rotation controlling means for rotating said cam by a predetermined amount.

5. A sheet supplying and conveying apparatus according to claim 2 or 3, wherein said separation rotary member is attached to a holder; and further comprising a spring for biasing said holder toward said convey roller to urge said separation rotary member against said convey roller, wherein said separation pressure releasing means includes an engagement portion provided on said pressure plate so that, when said pressure plate is shifted by said sheet supplying pressure releasing means, said engagement portion is engaged by said holder to separate said separation rotary member from said convey roller in opposition to an elastic force of said spring.

6. A sheet supplying and conveying apparatus according to claim 5, wherein said separation rotary member has a separation roller rotatably supported by a shaft secured to said holder, and said torque limiter has a coil spring wound around said shaft with a predetermined tightening force and having one end connected to said separation roller so that, (i) when said separation roller is subjected to rotational torque having a predetermined value or more in the sheet conveying direction, said coil spring is loosened to release the tightening force, thereby rotating said separation roller, and (ii) when said separation roller is subjected to rotational torque smaller than said predetermined value, the rotation of said separation roller is regulated by the tightening force of said coil spring.

7. A sheet supplying and conveying apparatus according to claim 2, further comprising a sheet returning means shifted from a downstream side to an upstream side to return a sheet remaining in the vicinity of a nip between said convey roller and said separation rotary member to said sheet supporting means when said separation rotary member is separated from said convey roller by said separation pressure releasing means.

8. A sheet supplying and conveying apparatus according to claim 7, wherein said sheet returning means has a return lever pivotally disposed in the vicinity of the nip between said convey roller and said separation rotary member, and a spring for biasing said return lever to return said return lever from the downstream side to the upstream side, and a spring force of said spring is set to shift said return lever toward the downstream side by the sheet conveyed by said convey roller.

9. A sheet supplying and conveying apparatus according to claim 1, further comprising a drive transmitting means for rotating said separation rotary member in a reverse direction, and said torque limiter is designed so that, (i) when said drive transmitting means is subjected to rotational torque having a predetermined value or more, drive transmission is interrupted, whereby, when said separation rotary member is subjected to the rotational torque having the predetermined value or more, the drive in the reverse direction is interrupted, and (ii) when said separation rotary member is subjected to rotational torque smaller than said predetermined value, the drive in the reverse direction is transmitted to said separation rotary member.

10. A sheet supplying and conveying apparatus according to claim 1, further comprising a guide means for guiding the sheet along a periphery of said convey roller to U-return and convey the sheet being conveyed by said guide means.

11. A sheet supplying and conveying apparatus according to claim 10, wherein said guide means has a guide plate disposed along the periphery of said convey roller, and a pinch roller urged against said convey roller.

12. A sheet supplying and conveying apparatus according to claim 1, wherein said convey roller is constituted by a plurality of elastic rollers disposed coaxially, and said separation rotary member is urged against at least one of said elastic rollers and pinch rollers are urged against the other elastic rollers to separate and convey the sheet.

13. A sheet supplying and conveying apparatus according to claim 12, wherein a hardness of the elastic roller against which said separation rotary member is urged is smaller than that of the other elastic rollers.

14. A sheet supplying and conveying apparatus according to claim 13, wherein a frictional coefficient of the elastic roller against which said separation rotary member is urged is greater than that of the other elastic rollers.

15. A sheet supplying and conveying apparatus comprising:

a liftable/lowerable sheet supporting means for supporting sheets;

a convey roller having a function for feeding out the sheet supported by said sheet supporting means and a function for conveying the fed sheet;

a guide means disposed along a periphery of said convey roller for cooperating with said convey roller to convey the sheet; and a separation means urged against said convey roller for separating the sheets from said sheet supporting means by said convey roller one by one;

wherein said convey roller is constituted by a plurality of elastic rollers disposed coaxially, and a hardness of the elastic roller against which said separation means is urged is smaller than that of the other elastic rollers.

16. A sheet supplying and conveying apparatus according to claim 15, wherein a frictional coefficient of the elastic roller against which said separation means is urged is greater than those of the other elastic rollers.

17. A sheet supplying and conveying apparatus according to claim 15 or 16, wherein said separation means is urged against the central elastic roller disposed among said plurality of elastic rollers.

18. A sheet supplying and conveying apparatus according to claim 15, wherein said guide means has a guide plate disposed along the periphery of said convey roller, and pinch rollers urged against said other elastic rollers against which said separation means is not urged.

19. A sheet supplying and conveying apparatus according to claim 18, wherein said convey roller and said guide means define a convey path through which the sheet is U-turned and conveyed.

20. A recording apparatus comprising:

a sheet supporting means for supporting sheets;

a convey roller contacted with the sheet supported by said sheet supporting means with a predetermined sheet supplying pressure and for feeding out the sheet and conveying the sheet around said convey roller by a rotation of said convey roller;

a separation rotary member urged against said convey roller with predetermined separation pressure for separating the sheets fed out by said convey roller one by one;

a torque limiter (i) for permitting a rotation of said separation rotary member in a sheet conveying direction when rotational torque directing toward the sheet conveying direction and having a value greater than a predetermined value acts on said separation rotary member, and (ii) for preventing the rotation of said separation rotary member in the sheet conveying direction when the rotational torque having a value smaller than the predetermined value acts on said separation rotary member;

a pressure releasing means for releasing the sheet supplying pressure and the separation pressure on the way of the conveyance of the sheet by said convey roller; and a recording means for executing recording to the sheet conveyed by said convey roller.

21. A recording apparatus comprising:

a liftable/lowerable sheet supporting means for supporting sheets;

a convey roller having a function for feeding out the sheet supported by said sheet supporting means and a function for conveying the fed sheets;

a guide means disposed along a periphery of said convey roller for cooperating with said convey roller to convey the sheet;

a separation means urged against said convey roller for separating the sheets from said sheet supporting means by said convey roller one by one; and a recording means for executing recording to the sheet conveyed by said convey roller;

wherein said convey roller is constituted by a plurality of elastic rollers disposed on a common shaft, and hardness of the elastic roller against which said separation means is urged is smaller than those of the other elastic rollers.

22. A recording apparatus comprising:

recording means for recording an image on a sheet;

sheet supporting means for supporting the sheets to be recorded on by said recording means;

a convey roller in contact with an uppermost sheet of the sheets supported by said sheet supporting means for feeding out the uppermost sheet from said sheet supporting means, said convey roller also conveying the sheet when said recording means records the image on the sheet;

a separation rotary member urged against said convey roller for separating the sheets fed out by said convey roller one by one;

a torque limiter (i) for permitting rotation of said separation rotary member in a sheet conveying direction when a rotational torque directed toward the sheet conveying direction and having a value greater than a predetermined value acts on said separation rotary member, and (ii) for preventing the rotation of said separation rotary member in the sheet conveying direction when the rotational torque having a value smaller than the predetermined value acts on said separation convey member; and releasing means for releasing the contact between said convey roller and the sheet supported by said sheet supporting means and the urge of said separation rotary member, during conveyance of the sheet by said convey roller.

23. A recording apparatus according to claim 22, wherein said convey roller conveys the sheet along a periphery of said convey roller in an U-return fashion, and said recording means records the image on the sheet U-returned by said convey roller.

24. A recording apparatus according to claim 23, wherein said sheet support means has a pivotable sheet support member for supporting the sheets and is biased by a first biasing means toward said convey roller; and said separation rotary member is biased towards said convey roller by a second biasing means, and said releasing means separates said sheet support member from said convey roller in opposition to a bias force of said first biasing means and separates said separation rotary member from said convey roller in opposition to a biasing force of said second biasing means.

25. A recording apparatus according to claim 22, wherein said recording means utilized an ink jet recording method for forming the image in which an ink is discharged by using thermal energy generated by an electrical-thermal converter.

* * * * *

UNITED STATES PATENT AND TRADEMARK OFFICE

CERTIFICATE OF CORRECTION

PATENT NO. : 5,725,208
DATED : March 10, 1998
INVENTOR(S) : Yasuo MIYAUCHI

It is certified that error appears in the above-identified patent and that said Letters Patent is hereby corrected as shown below:

Title Page, [56] References Cited, Other Documents, first entry, second line, delete "05-03931" and insert therefor --05-039131--.

Column 2, line 19, after "as", insert --a--.

Column 3, line 7, delete "in synchronous" and insert therefor --synchronously--.

Column 4, line 44, delete "be", first occurrence.

Column 5, line 40, delete "is" and insert therefor --are--;
Line 50, delete "later" and insert therefor --latter--.

Column 6, lines 21 and 22, delete "in synchronous" and insert therefor --synchronously--.

Column 8, line 26, delete "directing" and insert therefor --is directed--;
Line 62, delete "contacted" and insert therefor --contact--.

UNITED STATES PATENT AND TRADEMARK OFFICE

CERTIFICATE OF CORRECTION

PATENT NO. : 5,725,208
DATED : March 10, 1998
INVENTOR(S) : Yasuo Miyauchi

It is certified that error appears in the above-identified patent and that said Letters Patent is hereby corrected as shown below:

Column 10, line 55, delete "directing" and insert therefor --is directed--

Signed and Sealed this

Twenty-second Day of September, 1998

*Attest:*

Bruce Lehman

BRUCE LEHMAN

*Attesting Officer*

*Commissioner of Patents and Trademarks*